US008414327B2

(12) United States Patent
Mana et al.

(10) Patent No.: US 8,414,327 B2
(45) Date of Patent: Apr. 9, 2013

(54) VERY HIGH POWER CONNECTOR

(75) Inventors: Edith Mana, Voreppe (FR); Emilie Fond, Tullins (FR)

(73) Assignee: Radiall, Rosny-Sous-Bois (FR)

( * ) Notice: Subject to any disclaimer, the term of this patent is extended or adjusted under 35 U.S.C. 154(b) by 138 days.

(21) Appl. No.: 12/784,998

(22) Filed: May 21, 2010

(65) Prior Publication Data

US 2010/0304607 A1 Dec. 2, 2010

(30) Foreign Application Priority Data

May 29, 2009 (FR) ..... 09 53562

(51) Int. Cl.
*H01R 9/05* (2006.01)

(52) U.S. Cl.
USPC ..... 439/578

(58) Field of Classification Search ..... 439/578, 439/579
See application file for complete search history.

(56) References Cited

U.S. PATENT DOCUMENTS

| | | | | |
|---|---|---|---|---|
| 2,870,420 | A * | 1/1959 | Malek | 333/33 |
| 3,484,660 | A * | 12/1969 | Rosser | 257/746 |
| 3,514,741 | A | 5/1970 | Noren | |
| 3,783,434 | A | 1/1974 | Ransford, III | |
| 4,746,305 | A * | 5/1988 | Nomura | 439/319 |
| 5,046,966 | A * | 9/1991 | Snyder et al. | 439/579 |
| 7,128,604 | B2 | 10/2006 | Hall | |
| 2002/0021784 | A1 * | 2/2002 | Chornenky et al. | 378/143 |
| 2005/0085125 | A1 * | 4/2005 | Montena | 439/578 |
| 2006/0148315 | A1 * | 7/2006 | Andreescu | 439/583 |

FOREIGN PATENT DOCUMENTS

| | | |
|---|---|---|
| DE | 24 51 853 | 5/1976 |
| EP | 1 427 069 A1 | 6/2004 |

OTHER PUBLICATIONS

Preliminary Search Report issued for French Application No. 09 53562 on Dec. 10, 2009 (with translation).

* cited by examiner

*Primary Examiner* — Hien Vu
(74) *Attorney, Agent, or Firm* — Oliff & Berridge

(57) ABSTRACT

The present invention relates to a coaxial connector comprising:

a body; and a central contact mounted in the body with interposition of insulation;

wherein the insulation comprises at least two distinct portions:

a) that are separated by an interface presenting at least a fraction that extends obliquely relative to the axis of the connector; and/or b) that are made of different dielectric materials;

the connector being configured to withstand breakdown phenomena at altitude, in particular under vacuum conditions.

8 Claims, 2 Drawing Sheets

VERY HIGH POWER CONNECTOR

FIELD OF THE INVENTION

The present invention relates to a coaxial connector.

The invention applies more particularly to a coaxial connector for applications in the field of space, where such a connector is advantageously capable of withstanding high powers at altitude, and more particularly under vacuum conditions. The term "at altitude" should be understood as meaning an altitude greater than 30,000 feet. In the meaning of the invention, vacuum conditions are those of at least a primary vacuum, i.e. $10^5$ pascals (Pa), down to the conditions of the vacuum in space, i.e. $1.33\times10^{-8}$ Pa. The term "high powers" means powers of about 400 watts (W) at frequencies of 1 or 2 gigahertz (GHz), of 300 W at frequencies of 7 GHz, and of a few hundreds of watts at 18 GHz. The power to which the connector is subjected may for example be greater than 100 W.

BACKGROUND OF THE INVENTION

The higher the frequency of the signal, the larger the amount of heat that needs to be dissipated. In order to reduce the production of heat, it is known to increase the diameter of the central contact. Nevertheless, this increase in the diameter of the central contact leads to an increase in the diameter of the connector, and that can lead to problems in terms of bulk and can lower the cutoff frequency of the connector.

Application EP 1 427 069 discloses using a metal link connecting the body of a coaxial connector to a metal portion that enables heat to be transferred from the body to the metal portion. Such a solution does not improve the transfer of heat from the central contact to the body of the coaxial connector.

It is also known, e.g. from U.S. Pat. No. 7,128,604, to provide the body of a coaxial connector with fins that enable heat to be dissipated into air. Such a solution is not entirely satisfactory for applications in vacuum conditions. Furthermore, it does not improve the transfer of heat from the central contact towards the body of the coaxial connector.

In addition, in such vacuum conditions, there is a non-negligible risk of the connector being subjected to the multipactor effect, which corresponds to a discharge phenomenon that occurs in microwave or radiofrequency components.

It is known, e.g. from U.S. Pat. No. 4,698,028, to use insulation made up of two portions that define between them an interface that extends perpendicularly to or in parallel with the axis of the coaxial connector.

Application DE 24 51 853 discloses a coaxial connector including insulation made up of two portions interposed between the central contact and the ground contact of the connector. The two portions of the insulation are separated by an interface that is conical in part, thereby enabling the central contact to be centered in satisfactory manner. In particular as a result of using polyethylene and polytetrafluoroethylene (PTFE) for making the portions of the insulation, such a connector is not suitable for dissipating high powers at altitude, and more particularly under vacuum conditions.

There exists a need to benefit from a connector that is suitable for use in vacuum conditions, the connector being capable of dissipating heat to withstand high powers while avoiding any breakdown phenomena, in particular those due to the multipactor effect.

OBJECT AND SUMMARY OF THE INVENTION

An object of the invention is to satisfy this need, and exemplary embodiments of the invention achieve this object by means of a coaxial connector comprising:

a body; and a central contact mounted in the body with interposition of insulation;

wherein the insulation comprises at least two distinct portions:

a) that are separated by an interface presenting at least a fraction that is not colinear with the electric field lines within the connector, in particular that extends obliquely relative to the axis of the connector; and/or b) that are made of different dielectric materials.

The connector is advantageously configured to withstand powers of a few hundreds of watts, e.g. 100 W at frequencies lying in the range 1 GHz to 18 GHz, and in particular in the range 2 GHz to 18 GHz at altitude and/or in vacuum conditions.

The connector is advantageously capable of withstanding breakdown phenomena.

Breakdown phenomena correspond to avalanches of electrons to which metals are subjected at very low pressure because of very high electromagnetic fiefs that occur at high power levels, such avalanches of electrons causing electric discharges that may destroy components.

When a connector withstands breakdown phenomena, no avalanches of electrons occur across an empty space of the connector when said connector is in an alternating electric field.

The invention enables heat to be dissipated from the central contact towards the body of the coaxial connector via the insulation.

The two distinct portions of the insulation are advantageously separated by an interface presenting at least a fraction that extends obliquely relative to the axis of the connector. Such a fraction that is not colinear with the electric field lines that extend radially within the coaxial connector makes it possible to avoid creating avalanches of electrons in a vacuum and also makes it possible to avoid accumulating charge at the interfaces between the portions of the insulation, unlike prior art coaxial connectors in which the interfaces between the two portions of the insulation present a staircase-shape.

The body of the coaxial connector may be made as a single part or as a plurality of distinct parts. The at least two distinct portions of the insulation are advantageously made of different dielectric materials.

One of the portions of the insulation is advantageously made of a dielectric material presenting a thermal conductivity value that is different from that of the dielectric material of the other portion of the insulation.

At least one of the portions of the insulation is advantageously made of a dielectric material presenting a thermal conductivity value that is greater than 1 watt per meter kelvin (W/m·K).

The use of a plurality of dielectric materials for making the insulation enables the dissipation of heat to be improved in the coaxial connector, while optimizing the size of the connector and while conserving satisfactory performance at microwave frequencies.

The insulation advantageously comprises a front portion, a rear portion, and a middle portion between the front portion and the rear portion of the insulation along the axis of the coaxial connector.

The interface between the front portion and the middle portion of the insulation advantageously presents at least a fraction that extends obliquely relative to the axis of the coaxial connector, and the interface between the middle portion and the rear portion of the insulation advantageously presents at least a fraction that extends obliquely relative to the axis of the coaxial connector.

Said fraction of the interface between the front portion and the middle portion of the insulation and said fraction of the interface between the middle portion and the rear portion of the insulation may optionally be parallel. These portions may be directed in directions that become further apart from each other on going away from the central contact towards the body of the connector. In a variant, said fractions are directed in directions that extend towards each other on going away from the central contact towards the body of the connector.

In a variant, the interface between the front portion and the middle portion of the insulation includes at least a fraction that extends obliquely relative to the axis of the coaxial connector, and the interface between the middle portion and the rear portion of the insulation does not have such an obliquely-extending fraction, or vice versa.

The front, middle, and rear portions of the insulation are advantageously made of different dielectric materials.

The middle portion of the insulation is advantageously made of a dielectric material presenting a thermal conductivity value that is different from that of the dielectric material of the front portion and different from that of the dielectric material of the rear portion. By way of example, the middle portion is made of a dielectric material presenting a thermal conductivity value that is greater than that of the dielectric material of the front portion and less than that of the dielectric material of the rear portion, so as to further enhance the dissipation of heat in the coaxial connector. Thus, the middle and rear portions of the insulation may both be made of dielectric materials presenting thermal conductivity greater than 1 W/m·K. In a variant, only the rear portion of the insulation presents such a thermal conductivity value. In a variant, only the middle portion of the insulation presents such a thermal conductivity value.

The middle and rear portions are advantageously made of materials that present coefficients of linear thermal expansion that are less than those of the standard dielectrics that are conventionally used, such as PTFE.

By way of example, the front portion of the insulation may be made of a standard dielectric material enabling the coaxial connector to conserve a standard interface for coupling with a complementary connector.

One of the portions of the insulation, in particular the rear portion of the insulation, e.g. for insulation comprising two or three distinct portions, is advantageously configured to exert a holding action on a coaxial cable on which the connector is mounted, in particular on the insulation of said coaxial cable, thus making it possible, for example, to avoid certain a gap between the insulation of the coaxial connector and the insulation of the coaxial cable, particularly when the insulation of the cable might retract under the effect of thermal expansion, thereby further reducing any risk of breakdown due to the multipactor effect.

The dielectric material of said portion of the insulation that is configured to exert a holding action on the cable, in particular the rear portion of the insulation, e.g. when the insulation comprises two or three distinct portions, advantageously presents a coefficient of linear thermal expansion that is less than that of the dielectric of the cable. By way of example, said portion may also present a coefficient of linear thermal expansion that is less than that of at least one other portion of the insulation, e.g. the front and middle portions when the insulation comprises three distinct portions. Said portion of the insulation of the connector is advantageously adapted to the coaxial cable on which the connector is to be mounted. The coefficient of linear thermal expansion of said portion of the insulation may for example be less than 135 meters per meter per Kelvin (m/m/K) when the dielectric of the cable is made of PTFE (Teflon). By way of example, the dielectric portion of the cable and the other portions of the insulation then present coefficient of linear thermal expansion values that are greater than or equal to 135 m/m/K. Said portion of the insulation, e.g. the rear portion of the insulation, in particular when the insulation comprises two or three distinct portions, may include, for example, two jaws that are configured to be pressed against the insulation of the coaxial cable, and a sleeve that surrounds the outsides of the jaws, thereby enabling the connector to be held on a cable of semi-rigid type.

In a variant, said portion of the insulation configured to exert a holding action on the cable may include a tapped fraction for bearing against the insulation of the coaxial cable, e.g. when the cable is of the flexible type. Under such circumstances, said portion of the insulation may be made as a single piece, for example.

The fraction of the interface that extends obliquely relative to the axis of the coaxial connector advantageously defines a surface that is conical. Such a conical surface advantageously intersects the electric field lines within the coaxial connector.

In a variant, the insulation advantageously comprises a front portion, a first intermediate portion, a middle portion, a second intermediate portion, and a rear portion along the axis of the coaxial connector, at least two of said portions defining between them an interface including at least a fraction that extends obliquely relative to said axis.

The front portion and the rear portion of the insulation are advantageously made of standard dielectric materials.

The first and second intermediate portions are advantageously made of dielectric materials that present thermal conductivity greater than that of the dielectric materials of the front and rear portions.

The middle portion is advantageously made of glass or of a material similar to glass, also referred to as a glass bead. A coaxial connector presenting insulation as defined above is capable of presenting satisfactory hermetic sealing properties.

The interface between the first intermediate portion and the middle portion of the insulation advantageously defines a conical surface, and the interface between the middle portion and the second intermediate portion of the insulation advantageously defines a conical surface, such that the middle portion of the insulation is biconical in shape, thereby enabling any risk of breakdown due to the multipactor effect to be further reduced.

A passage of generally cylindrical shape is advantageously formed through the insulation to receive the central contact. Such a passage may be constituted by a single cylindrically-shaped fraction or by a plurality of cylindrically-shaped fractions of different diameters. The passage and the central contact may for example be such that when the central contact is in position in said passage, the central contact and the insulation make contact solely via cylindrical surfaces.

The outside surface of the coaxial connector advantageously includes, over at least a fraction thereof, a coating that presents a ratio of thermal absorptivity divided by thermal emissivity that is less than 1.

Such a coating, whether covering the outside surface of the coaxial connector in full or in part, serves to enhance the dissipation of heat from the connector into a vacuum.

The invention thus enables the heat stemming from high powers passing through the connector to be dissipated both from the central connector towards the body and from the body towards the outside.

Advantageously, the coating comprises a metal layer covered in a layer of fluorinated resin, in particular of PTFE. By way of example, the metal layer presents low absorptivity while the fluorinated resin layer presents high emissivity.

The body and/or the sleeve and/or a cap of the connector may for example be provided with said coating over at least a fraction of their outside surfaces, and in particular their lateral outside surfaces.

Other exemplary embodiments of the invention also provide a coaxial connector comprising:

a body; and a central contact mounted in the body with interposition of insulation;

wherein the outside surface includes a coating over at least a fraction thereof that presents a ratio of thermal absorptivity divided by thermal emissivity that is less than 1.

The coaxial connector advantageously includes a body provided over at least a fraction of its outside surface with said coating.

The coaxial connector advantageously includes a sleeve provided over at least a fraction of its outside surface with said coating.

The coaxial connector advantageously includes a cap provided over at least a fraction of its outside surface with said coating.

The coating may extend over all or part of the periphery of the coaxial connector.

Other exemplary embodiments of the invention also provide a coaxial connector comprising:

a body; and a central contact mounted in the body with interposition of insulation;

wherein:

the insulation includes at least two distinct portions separated by an interface presenting at least a fraction that is not colinear with the electric field lines in the connector, and extending in particular obliquely relative to the axis of the connector; and/or one of the portions of the insulation, in particular the rear portion of the insulation, in particular of insulation comprising three distinct portions, is configured to exert a holding action on the insulation of the coaxial cable on which the connector is mounted.

A connector presenting insulation in two portions with an interface having at least a fraction that is not colinear with the radial electric field lines within the coaxial connector serves to avoid creating avalanches of electrons in a vacuum and serves to avoid charge accumulating at the interfaces between the portions of the insulation, as explained above.

A connector presenting insulation having a portion that is configured to exert a holding action on the insulation of the coaxial cable on which the connector is mounted makes it possible, because of this holding action, to avoid creating a gap between the insulation of the coaxial connector and the insulation of the coaxial cable, in particular as a result of the insulation of the cable backing off under the effect of thermal expansion.

With a connector presenting both characteristics described above, the risks of breakdown associated with the multipactor effect are reduced significantly.

Such a connector presenting one and/or the other of the above-described characteristics may be configured to withstand powers of a few hundreds of watts, e.g. 100 watts, at frequencies lying in the range 1 GHz to 18 GHz, in particular in the range 2 to 18 GHz, at altitude and/or in vacuum conditions. Such a connector is advantageously configured to withstand breakdown phenomena at altitude, in particular under vacuum conditions.

The dielectric material of said portion of the insulation arranged to exert a holding action on the cable, in particular the rear portion of the insulation, advantageously presents a coefficient of linear thermal expansion that is less than that of the dielectric of the cable. By way of example, said portion may also present a coefficient of linear thermal expansion less than that of at least one other portion of the insulation, e.g. the front and middle portions when the insulation comprises three distinct portions. The value of the coefficient of linear thermal expansion of the rear portion of the insulation is less than 135 m/m/K when the dielectric of the cable is PTFE, the dielectric portion of the cable and the other portions of the insulation presenting values for their coefficients of linear thermal expansion that are greater than or equal to 135 m/m/K.

Said portion of the insulation of the connector is advantageously adapted to the coaxial cable on which the connector is to be mounted.

Said portion of the insulation, e.g. the rear portion of the insulation, in particular when the insulation comprises three distinct portions, comprises for example two jaws that are configured to be pressed against the insulation of the coaxial cable, and a sleeve surrounding the outsides of the jaws, thereby making it possible to retain the connector on a cable of semirigid type.

In a variant, said portion of the insulation that is configured to exert a holding action on the cable may include a tapped fraction that is configured to press against the insulation of the coaxial cable, e.g. when the cable is of the flexible type. Under such circumstances, said portion of the insulation may be made as a single piece, for example.

The invention also provides an assembly comprising the above-described connector together with the coaxial cable on which the connector is mounted, the insulation of the connector including at least one portion that is configured to exert a holding action on the insulation of the coaxial cable.

BRIEF DESCRIPTION OF THE DRAWINGS

Other advantages and properties of the invention appear on reading the following description of non-limiting embodiments made with reference to the accompanying drawings, in which.

MORE DETAILED DESCRIPTION

Figure 1:
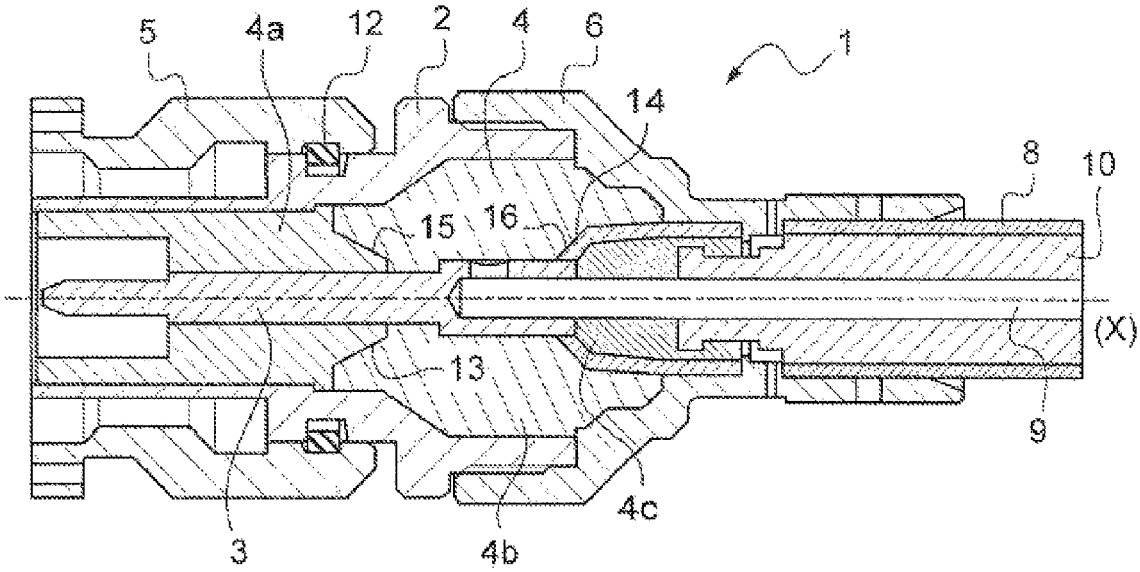
FIG. 1 is a section view of a coaxial connector constituting an embodiment of the invention.

FIG. 1 shows an example of a coaxial connector of axis X, e.g. a connector of the TNC type, given overall reference 1. This coaxial connector 1 in the example describes comprises a body 2 made as a single piece, and a central contact 3 mounted in the body 2 with interposition of insulation 4. A passage 7 of cylindrical shape is formed in the insulation 4 to receive the central contact 3, which has an outside shape that is substantially cylindrical in the example shown.

In the example described, the coaxial connector 1 also includes a cap 5 mounted on the front of the body 2, and a sleeve 6 mounted on the rear of the body 2. In the example described, the cap 5 defines a front portion of the connector 1 suitable for coupling to a complementary coaxial connector, while the sleeve 6 defines a rear portion of the connector 1 for mounting on a coaxial cable 8.

As can be seen in FIG. 1, the coaxial cable 8 has a central contact 9 and insulation 10 surrounding the central contact 9, and the cable 8 is suitable for being received inside the sleeve 6 of the coaxial connector 1.

In the example described, the coaxial connector 1 also includes an annular gasket 12 located between the body 2 and the cap 5.

In the example of FIG. 1, the insulation 4 comprises three distinct portions 4*a*, 4*b*, and 4*c* along the axis X of the connector 1, however the invention is not limited to any specific number of portions for the insulation 4, as explained below.

The portions 4*a*, 4*b*, and 4*c* of the insulation 4 are made of dielectric materials, and in particular of different dielectric materials.

By way of example, the front portion 4*a* of the insulation is made of a standard dielectric material, e.g. Teflon®, presenting thermal conductivity equal to 1 W/m·K. By way of example, the middle and rear portions 4*b* and 4*c* are made of dielectric materials that present thermal conductivity values that are greater than that of the dielectric material of the front portion 4*a*. The rear portion 4*c* may also be made of a dielectric material that presents a thermal conductivity value that is greater than that of the dielectric material of the middle portion 4*b*.

As can be seen in FIG. 1, both the interface 13 between the front portion 4*a* and the middle portion 4*b* of the insulation, and the interface 14 between the middle portion 4*b* and the rear portion 4*c* of the insulation, include at least a respective fraction 15, 16 that extends obliquely relative to the axis X of the coaxial connector 1.

In the example described, these fractions 15 and 16 define conical surfaces. Such conical surfaces intersect the electric field lines within the coaxial connector 1, which field lines extend radially relative to the axis X of the connector. In this way, electrons are absorbed by the insulation portions without it being possible for them to be re-emitted, thus avoiding potential accumulation of charge.

In the example of FIG. 1, the fractions 15 and 16 are not parallel and they become further apart from each other on going away from the central contact 3 towards the body 2 of the connector.

Examples of rear portions 4*c* of the insulation 4 of the coaxial connector 1 are described below in greater detail with reference to FIGS. 2 and 3.

Figure 2:
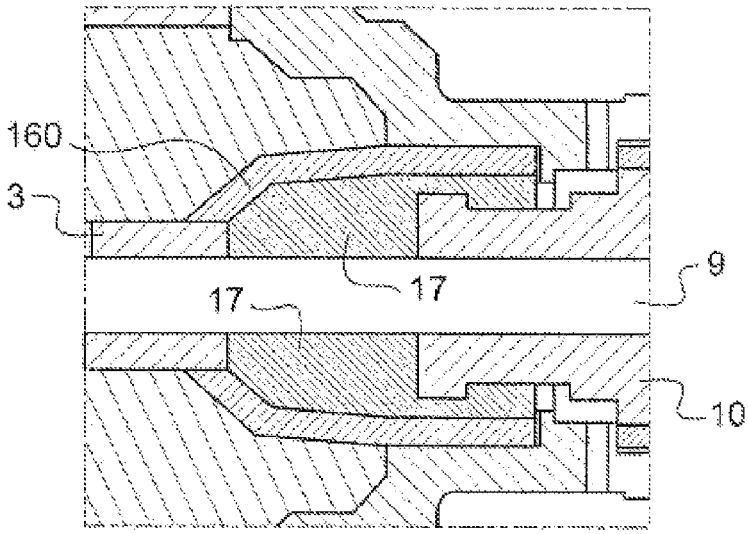
FIG. 2 shows a detail of FIG. 1.

In the example of FIG. 2, the rear portion 4*c* of the insulation 4 comprises three distinct parts, namely a sleeve 160 and two jaws 17. The two jaws 17 are designed to be pressed against the insulation 10 of the coaxial cable 8 so as to retain the connector 1 on the coaxial cable 8. The sleeve 160 surrounds the outside of the jaws 17, holding them against the insulation 10 of the cable. Such a rear portion 4*c* is particularly adapted to holding a coaxial cable 8 of semirigid type.

Figure 3:
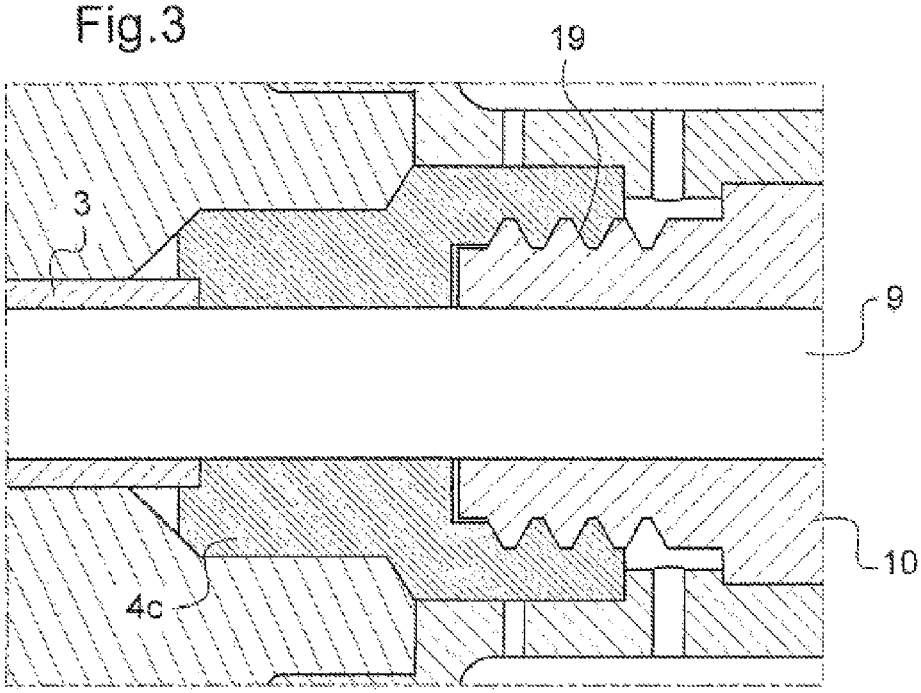
FIG. 3 shows a variant of the rear portion of the insulation of the connector shown in FIG. 2.
Figure 4:
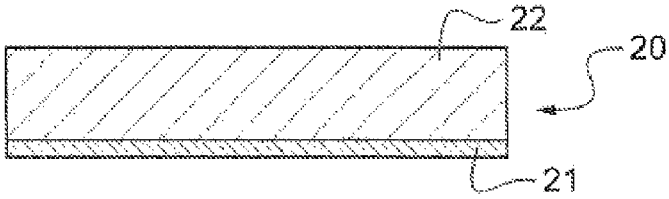
FIG. 4 shows an example of coating carried by the lateral outside surface of the body of the connector.

In the variant shown in FIG. 3, the rear portion 4*c* of the insulation is a single piece and comprises a fraction having internal tapping 19 that penetrates into the insulation 10 of the cable 8 when the connector 1 is mounted on the coaxial cable 8. Such a rear portion 4*c* is particularly adapted to holding the connector 1 on a coaxial cable 8 of flexible type. The insulation 10 of such a flexible cable may optionally be pre-threaded, depending on the flexibility of the coaxial cable 8.

In other variants that are not shown, the insulation 4 has only two distinct portions, with one of said portions comprising a sleeve 160 and two jaws 17, similar to the description with reference to FIG. 2, or said portion has a fraction presenting internal tapping 19, similar to that described with reference to FIG. 3.

Figure 5:
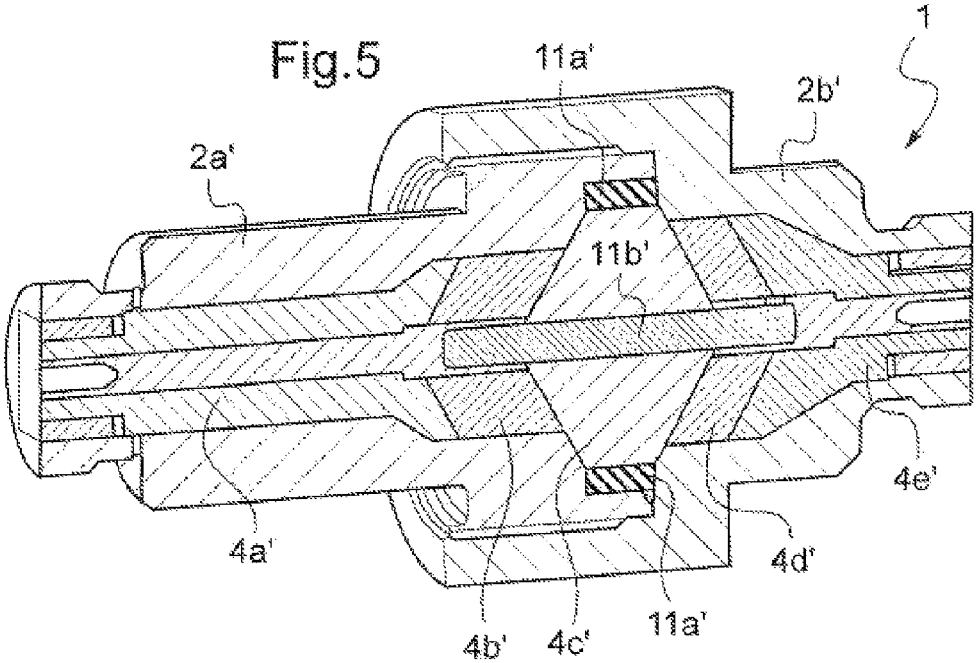
FIG. 5 is a view analogous to FIG. 1 showing a body and insulation of a coaxial connector constituting another embodiment of the invention.

With reference to FIG. 5, there follows a description of another example of a body and insulation for a coaxial cable of the invention. In this example, the body 2 of the connector comprises two portions 2*a*' and 2*b*', and the insulation comprises five distinct portions 4*a*', 4*b*', 4*c*', 4*d*', and 4*e*' that follow one after the other along the axis X of the coaxial connector 1.

By way of example, the front portion 4*a*' of the insulation is made of a standard dielectric material such as Teflon®, for example, so as to conserve a standard interface for the coaxial connector for coupling with a complementary coaxial connector. In the example described, the intermediate portions 4*b*' and 4*d*' are made of dielectric materials having thermal conductivity that is greater than that of the dielectric material of the front portion 4*a*'.

The portion 4*c*' is made of glass or of a material similar to glass, and is referred to as a glass bead. As can be seen in FIG. 5, this middle portion 4*c*' is surrounded externally by an annular element 11*a*' and it is pierced internally substantially in its middle on the axis X by a cylindrical central contact 11*b*'. By way of example, the middle portion 4*c*' is molded directly on the annular element 11*a*' and the cylindrical central contact 11*b*'.

By way of example, the annular element 11*a*' and the cylindrical central contact 11*b*' are made of a metal material that presents thermal expansion close to that of glass, e.g. Dilver P®.

In the example described, the annular element 11*a*', the central contact 11*b*', and the middle portion 4*c*' of the insulation are brazed by laser on the portion 2*b*' of the body.

The rear portion 4*e*' of the insulation may be made of a standard dielectric material, e.g. Teflon®, so as to conserve a standard interface for the coaxial connector 1' for receiving the coaxial cable.

By way of example, the portion 4*c*' of the insulation cooperates with the adjacent portions 4*b*' and 4*d*' of the insulation to define interfaces that present opposite slopes, so that the portion 4*c*' is of biconical shape, thereby enabling hermetic properties to be conferred on the resulting connector, while limiting the risks associated with the multipactor effect.

The body 2, the sleeve 6, and/or the cap 5 may include a coating 20 over at least a fraction of their lateral outside surfaces, and in particular over their entire lateral outside surfaces, which coating 20 presents a ratio of thermal absorptivity divided by thermal emissivity that is less than 1, thereby serving to improve the dissipation of heat outwards from the body 2, the sleeve 6, and/or the cap 5. By way of example, this coating 20 comprises a layer 21 of bright metal, e.g. silver, covered in a layer 22 of fluorinated resin, e.g. PTFE.

The invention is not limited to the examples described above.

In the claims, the term "comprises a" should be understood as being synonymous with "comprises at least one" unless specified to the contrary.

What is claimed is:

1. A coaxial connector extending along a longitudinal axis, the coaxial connector comprising:

a body that is oriented along the longitudinal axis; and a central contact mounted in the body with interposition of insulation positioned in the body, wherein the insulation comprises three distinct portions: a front portion, a rear portion, and a middle portion connecting between the front portion and the rear portion along the longitudinal axis of the coaxial connector, the front, middle and rear portions being made of different dielectric materials, a first interface between the front portion and the middle portion of the insulation presents at least a fraction that extends obliquely relative to the longitudinal axis of the coaxial connector, a second interface between the middle portion and the rear portion of the insulation presents at least a fraction that extends obliquely relative to the longitudinal axis of the coaxial connector;

both the fraction of the first interface that extends obliquely relative to the longitudinal axis and the fraction of the second interface that extends obliquely relative to the longitudinal axis, being not collinear with electric field lines that extend radially within the coaxial connector, avoid creating avalanches of electrons in a vacuum and also avoid accumulating charge at the first interface and the second interface; and a portion of the insulation, in particular the rear portion of the insulation, is configured to exert a holding action on an insulation of a coaxial cable which is mounted into the rear portion and the central contact.

2. The coaxial connector according to claim 1, wherein one of the front, middle and rear portions of the insulation is made of a dielectric material presenting a thermal conductivity value that is different from that of a dielectric material of another of the front, middle and rear portions of the insulation.

3. The coaxial connector according to claim 1, wherein the dielectric material of said portion of the insulation that is configured to exert a holding action presents a linear coefficient of thermal expansion that is less than that of dielectric material of the coaxial cable.

4. The coaxial connector according to claim 1, wherein said portion of the insulation that is configured to exert a holding action includes:

two jaws configured to press against the insulation of the coaxial cable, and a sleeve surrounding the jaws on a periphery of the jaws.

5. The coaxial connector according to claim 1, wherein at least one of the fraction of the first interface that extends obliquely relative to the longitudinal axis of the coaxial connector and the fraction of the second interface that extends obliquely relative to the longitudinal axis of the coaxial connector defines a surface that is conical.

6. The coaxial connector according to claim 1, wherein a lateral outside surface of the coaxial connector includes a coating over at least a fraction of the lateral outside surface, wherein the coating presents a ratio of thermal absorptivity divided by thermal emissivity that is less than 1.

7. A coaxial connector mounted on a coaxial cable, the coaxial connector comprising:

a body; and a central contact mounted in the body with interposition of insulation positioned in the body, wherein:

the insulation of the coaxial connector comprises at least two distinct portions each having an oblique interface separated by a middle portion having an interface presenting at least a fraction that extends obliquely relative to a longitudinal axis of the coaxial connector, a rear portion of the insulation of the coaxial connector and the insulation of the coaxial cable both having holding means configured to mutually cooperate in order to exert a holding action of the rear portion of the insulation of the coaxial connector on the insulation of the coaxial cable that is mounted into the rear portion and the central contact, and the holding means of the insulation of the coaxial connector comprises a protrusion, and the holding means of the insulation of the coaxial cable comprises a recess formed on the insulation of the coaxial cable, the protrusion being configured to engage with the recess.

8. The coaxial connector according to claim 6, wherein the coating comprises an inner metallic layer, and an outer resin layer.

* * * * *